US010393109B2

(12) United States Patent
Wu et al.

(10) Patent No.: US 10,393,109 B2
(45) Date of Patent: Aug. 27, 2019

(54) PIEZOELECTRIC PUMP HAVING A VIBRATING PIECE HAVING A VIBRATING PIECE HAVING A CENTRAL ZONE, A PERIPHERAL ZONE, A FIRST RECESS, A STOPPER, AT LEAST ONE POSITION LIMITING WALL, AND AT LEAST ONE THROUGH GROOVE AND OPERATING METHOD THEREOF

(71) Applicant: Koge Micro Tech Co., Ltd., New Taipei (TW)

(72) Inventors: Chung-Han Wu, Taipei (TW); Yu-Chang Yen, New Taipei (TW)

(73) Assignee: Koge Micro Tech Co., Ltd., New Taipei (TW)

( * ) Notice: Subject to any disclaimer, the term of this patent is extended or adjusted under 35 U.S.C. 154(b) by 490 days.

(21) Appl. No.: 14/855,392

(22) Filed: Sep. 16, 2015

(65) Prior Publication Data

US 2016/0377072 A1 Dec. 29, 2016

(30) Foreign Application Priority Data

Jun. 25, 2015 (TW) ..... 104120510 A

(51) Int. Cl.
*F04B 53/10* (2006.01)
*F04B 17/00* (2006.01)
*F04B 43/04* (2006.01)

(52) U.S. Cl.
CPC ..... *F04B 53/10* (2013.01); *F04B 17/003* (2013.01); *F04B 43/04* (2013.01)

(58) Field of Classification Search
CPC ..... F04B 17/003; F04B 43/04; F04B 53/10; F04B 43/046

(Continued)

(56) References Cited

U.S. PATENT DOCUMENTS 4,756,508 A * 7/1988 Giachino ..... B41J 2/17596 239/102.2
5,029,805 A * 7/1991 Albarda ..... B41J 2/17596 251/11

(Continued)

FOREIGN PATENT DOCUMENTS

CN 101490419 7/2009
CN 102979705 3/2013

(Continued)

OTHER PUBLICATIONS

"Office Action of German Counterpart Application," with English translation thereof, dated Apr. 24, 2017, p. 1-p. 8, in which the listed references were cited.

(Continued)

*Primary Examiner* — Devon C Kramer
*Assistant Examiner* — Benjamin Doyle
(74) *Attorney, Agent, or Firm* — JCIPRNET

(57) ABSTRACT

A piezoelectric pump includes a piezoelectric element, a vibrating piece, a valve and a flow guiding member. The vibrating piece has a central zone attached to the piezoelectric element, a peripheral zone, a first recess, a stopper and a position limiting wall both protruding from the first recess, and a through groove disposed between the central zone and the peripheral zone and connected through the first recess. The valve is attached to the peripheral zone and has a non-straight through slit. The flow guiding member is attached to the valve and has a second recess and a channel both recessed in the flow guiding member, and a through hole. The channel is connected through the second recess and the through hole. A projection of the second recess projected on the plane which the valve exists covers the non-straight through slit. An operating method of a piezoelectric pump is further provided.

9 Claims, 10 Drawing Sheets

(58) Field of Classification Search
USPC ..... 417/413.2, 413.3, 479, 322; 251/129.06
See application file for complete search history.

(56) References Cited

U.S. PATENT DOCUMENTS 5,647,574 A * 7/1997 Mettner ..... F15C 5/00 251/129.01
5,954,079 A * 9/1999 Barth ..... F15C 5/00 137/13
5,964,242 A * 10/1999 Slocum ..... F15C 5/00 137/240
6,033,191 A * 3/2000 Kamper ..... F04B 43/043 417/322
6,116,863 A * 9/2000 Ahn ..... F04B 43/043 417/322
6,914,785 B1 * 7/2005 Slocum ..... H01G 5/18 174/252
7,025,324 B1 * 4/2006 Slocum ..... B01L 3/502738 251/11
7,631,852 B2 * 12/2009 Richter ..... F04B 43/043 251/129.06
8,939,165 B2 * 1/2015 Reichenbach ..... F04B 19/006 137/15.18
9,574,674 B2 * 2/2017 Maeda ..... F16K 7/17
2005/0175490 A1 * 8/2005 Seto ..... F04B 43/04 417/559
2006/0140782 A1 * 6/2006 Weber ..... F04B 43/046 417/221
2006/0232167 A1 * 10/2006 Jordan ..... F04B 43/0054 310/324
2006/0245949 A1 * 11/2006 Ball, Jr. ..... F04B 43/02 417/413.2
2006/0245951 A1 * 11/2006 Ball, Jr. ..... F04B 53/1037 417/413.3
2009/0092503 A1 * 4/2009 Meng ..... F04B 43/046 417/322
2009/0148318 A1 * 6/2009 Kamitani ..... F04B 43/04 417/413.2
2009/0232680 A1 * 9/2009 Kitahara ..... F04B 43/0054 417/413.2
2009/0232683 A1 * 9/2009 Hirata ..... F04B 43/046 417/413.2
2009/0232684 A1 * 9/2009 Hirata ..... F04B 39/1093 417/413.2
2009/0232685 A1 * 9/2009 Kamitani ..... F04B 43/046 417/413.2
2011/0070110 A1 * 3/2011 Hirata ..... F04B 43/043 417/413.2
2011/0076170 A1 * 3/2011 Fujisaki ..... F04B 45/047 417/415
2012/0171062 A1 * 7/2012 Kodama ..... F04B 43/046 417/413.2
2013/0058810 A1 * 3/2013 Hirata ..... F04B 43/043 417/413.2
2013/0058818 A1 * 3/2013 Hirata ..... F04B 43/046 417/479
2013/0058819 A1 * 3/2013 Kodama ..... F04B 43/043 417/479
2013/0266461 A1 * 10/2013 Hirata ..... F04B 17/003 417/413.2
2013/0287607 A1 10/2013 Kuznetsov
2015/0071797 A1 * 3/2015 Takeuchi ..... F04B 43/0054 417/413.2
2016/0377072 A1 * 12/2016 Wu ..... F04B 53/10 417/53

FOREIGN PATENT DOCUMENTS

| | | | |
|---|---|---|---|
| CN | 104302913 | 1/2015 | |
| EP | 0722541 | 7/1996 | |
| EP | 2312158 | * 4/2011 | ..... F04B 45/047 |
| EP | 2568177 | 10/2015 | |
| JP | H10299659 | 11/1998 | |
| JP | 5652551 | 1/2015 | |
| TW | 200726913 | 7/2007 | |
| TW | M513272 | 12/2015 | |

OTHER PUBLICATIONS

"Office Action of Taiwan Counterpart Application", dated Jan. 28, 2016, p. 1-p. 4, in which the listed references were cited.
"Office Action of China Counterpart Application," dated Dec. 13, 2017, p. 1-p. 7, in which the listed references were cited.

* cited by examiner

PIEZOELECTRIC PUMP HAVING A VIBRATING PIECE HAVING A VIBRATING PIECE HAVING A CENTRAL ZONE, A PERIPHERAL ZONE, A FIRST RECESS, A STOPPER, AT LEAST ONE POSITION LIMITING WALL, AND AT LEAST ONE THROUGH GROOVE AND OPERATING METHOD THEREOF

CROSS-REFERENCE TO RELATED APPLICATION

This application claims the priority benefit of Taiwan application serial no. 104120510, filed on Jun. 25, 2015. The entirety of the above-mentioned patent application is hereby incorporated by reference herein and made a part of this specification.

BACKGROUND OF THE DISCLOSURE

1. Field of the Disclosure

The disclosure relates to a piezoelectric pump and operating method thereof. More particularly, the disclosure relates to a piezoelectric pump and operating method thereof capable of suppressing back flow and improving transmission efficiency.

2. Description of Related Art

Piezoelectric pumps are novel sorts of fluid actuators, in which no drive motor is required and, implement fluid transmission merely via the inverse piezoelectric effect of the piezoelectric ceramics which make the piezoelectric vibrator deforms so that the deformation of the piezoelectric vibrator causes the volume change of the pump chamber, or transmit fluid via the fluctuations generated by the piezoelectric vibrator. Therefore, the piezoelectric pumps have gradually replaced the conventional pumps and are widely used in electronics, biomedical, aerospace, automotive and petrochemical industries.

In general, a piezoelectric pump includes a piezoelectric vibrator and a pump body, wherein when the piezoelectric vibrator is electrically powered, the piezoelectric vibrator may radially compressed due to electric field, and bending and deformation may occur due to the induced internal tension stress. When the piezoelectric vibrator bends in a forward direction, the volume of the chamber of the pump body (hereinafter pump chamber) may increase, so that the pressure within the pump chamber is reduced, such that the fluid may flow into the pump chamber from the inlet. On the other hand, when the piezoelectric vibrator bends in a backward direction, the volume of the pump chamber may decrease, so that the pressure within the pump chamber is increased, such that the fluid within the pump chamber is squeezed and may flow out from the outlet. Therefore, how to maintain the fluid to flow into the pump chamber through the inlet and flow out of the pump chamber through the outlet without occurrence of back flow when the piezoelectric vibrator actuates has become one of the current urgent problems to be solved.

SUMMARY OF THE DISCLOSURE

The disclosure provides a piezoelectric pump capable of suppressing back flow of the fluid and enhancing fluid transmission efficiency.

An operating method of a piezoelectric pump adapted to the abovementioned piezoelectric pump is also provided.

A piezoelectric pump of the disclosure includes a piezoelectric element, a vibrating piece, a valve and a flow guiding member. The vibrating piece includes a central zone, a peripheral zone, a first recess, a stopper, at least one position limiting wall and at least one through groove. The central zone corresponds to the piezoelectric element, and the central zone of the vibrating piece is attached to the piezoelectric element. The peripheral zone surrounds the central zone. The first recess is recessed in the surface which is away from the piezoelectric element, of the central zone. The stopper and the position limiting protrude from the first recess, and the through groove is located between the central zone and the peripheral zone and communicated with the first recess. The valve is attached to the surface which is away from the piezoelectric element, of the peripheral zone of the vibrating piece and has at least one non-straight through slit. A projection of the stopper of the vibrating piece projected on the valve covers the non-straight through slit. The flow guiding member is attached to the surface which is away from the vibrating piece, of the valve, and has a second recess, at least one channel and at least one through hole. The second recess and the channel are recessed in the surface which faces the valve, of the flow guiding member. The channel is communicated with the second recess and the through hole. A projection of the second recess projected on the plane which the valve exists covers the non-straight through slit. When the piezoelectric element is driven by a driving voltage at a specific frequency, the vibrating piece and the valve relatively resonantly vibrate, such that the central zone of the vibrating piece and a region of the valve corresponding to the central zone have a maximum amplitude.

According to an embodiment of the disclosure, the piezoelectric element includes a perforating hole, the vibrating piece includes a third recess, the third recess is recessed in a surface which is near to the piezoelectric element, of the central zone and corresponds to a location of the perforating hole.

According to an embodiment of the disclosure, the vibrating piece includes a plurality of arm portions, respectively connected to the central zone and the peripheral zone, the arm portions extend in a straight line or an arc line.

According to an embodiment of the disclosure, the valve includes a plurality of perforating grooves, the flow guiding member includes a plurality of slots, locations of the perforating grooves and the slots respectively correspond to locations of the arm portions, for the arm portions extending thereinto.

According to an embodiment of the disclosure, the valve includes a fourth recess, the fourth recess is recessed in the surface which faces the flow guiding member, of the valve, and the fourth recess corresponds to the second recess.

According to an embodiment of the disclosure, the inlet diameter of the channel gradually decreases from the through hole to the second recess.

According to an embodiment of the disclosure, the vibrating piece includes a plurality of position limiting walls, the position limiting walls surround the stopper, the shape of projection of each of the position limiting walls projected on the valve includes a curved shape, an elongated shape, a round shape, a square shape, a circular shape or an irregular shape, or the vibrating piece includes the position limiting wall, a shape of the position limiting wall is a circular shape and surrounds the stopper.

According to an embodiment of the disclosure, the shape of projection of the stopper projected on the valve includes a round shape, an elliptical shape, or a polygonal shape or an irregular shape.

According to an embodiment of the disclosure, the shape of each of the non-straight through slits includes an arc shape, a U shape, a part of a polygonal shape or an irregular shape.

The operating method of the piezoelectric pump of the disclosure includes providing the piezoelectric pump above-mentioned; providing a driving voltage at a specific frequency to drive the piezoelectric element, wherein the vibrating piece and the valve relatively resonantly vibrate, such that the central zone of the vibrating piece and a region of the valve corresponding to the central zone have a maximum amplitude.

In light of the above, the piezoelectric element of the piezoelectric pump of the disclosure may moves up and down when electrically powered, besides directly driving the vibrating piece, by inputting a driving voltage at a specific frequency to the piezoelectric element, the vibrating piece and the valve may generate a resonantly vibrating status in which the central zone of the vibrating piece and the region of the valve corresponding to the central zone may have a maximum amplitude, thereby increasing the vibrating amplitude of the vibrating piece and the valve, and further capable of driving the fluid to flow through. In more detailed, when the piezoelectric element moves in a direction away from the flow guiding member, the central zone of the vibrating piece is away from the valve, the stopper and the position limiting wall may be separated from the valve by a small distance, such that the fluid may be guided to a space between the valve and the first recess of the vibrating piece from the through hole, the channel, the second recess, and the non-straight through slit. Via the design of the non-straight through slit, when the fluid passes through the non-straight through slit, the non-straight through slit may be opened and increase the size of the opening due to the resonant vibration, thereby the flow resistance is reduced and the ventilation rate is increased. When the piezoelectric element is back to its position and moves in a direction near to the flow guiding member, the fluid located between the valve and the first recess of the vibrating piece may be squeezed out of the through groove of the vibrating piece, and the central zone of the vibrating piece may approach the valve, the non-straight through slit may be restored to be the planar slit status due to the resonant vibration, the opening of the non-straight through slit may become smaller and thus the flow resistance increases, further, the stopper protruding from the first recess may prop against the valve and shield the non-straight through slit, the fluid is hard to flow to the second recess of the flow guiding member from the non-straight through slit. In other words, the flow resistance of the flow path between the valve and the flow guiding member may gradually be increased and temporarily closed, so as to achieve the status of suppressing back flow of the fluid. In addition, the vibrating piece has a position limiting wall, disposed on the surface which faces the valve, which may limit the magnitude of movement of the vibrating piece when it moves in a direction to the valve, namely, the magnitude of movement of the vibrating piece moving in a direction away from the valve may be larger than the magnitude of the movement moving in a direction near to the valve, such that the fluid may flow into the piezoelectric pump from the through hole in a single direction, passing through the channel, the second recess, the non-straight through slit, the first recess, and then leaves the piezoelectric pump via the through groove.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
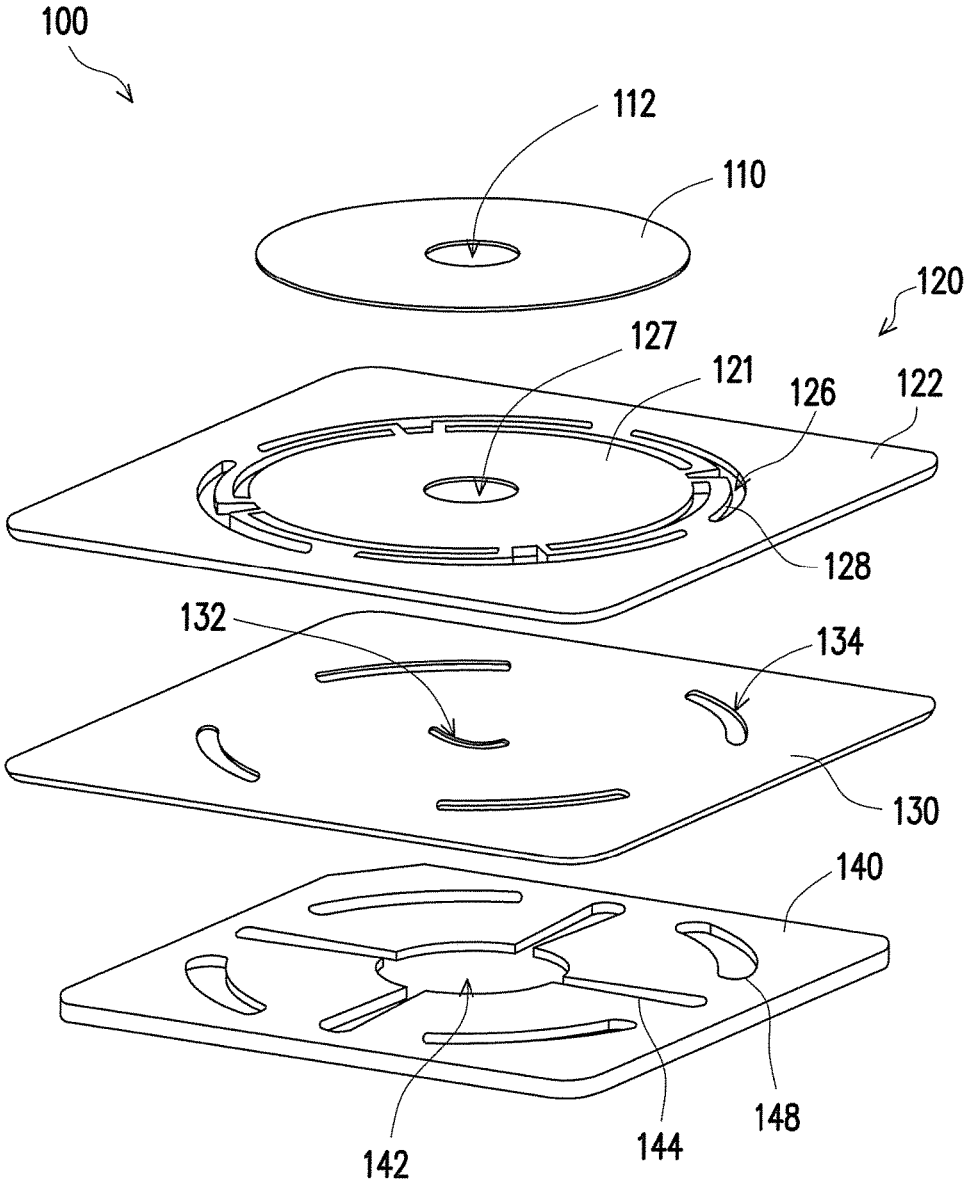
FIG. 1 is a schematic exploded view of a piezoelectric pump according to an embodiment of the disclosure.

Reference will now be made in detail to the present preferred embodiments of the invention, examples of which are illustrated in the accompanying drawings. Wherever possible, the same reference numbers are used in the drawings and the description to refer to the same or like parts.

Figure 2:
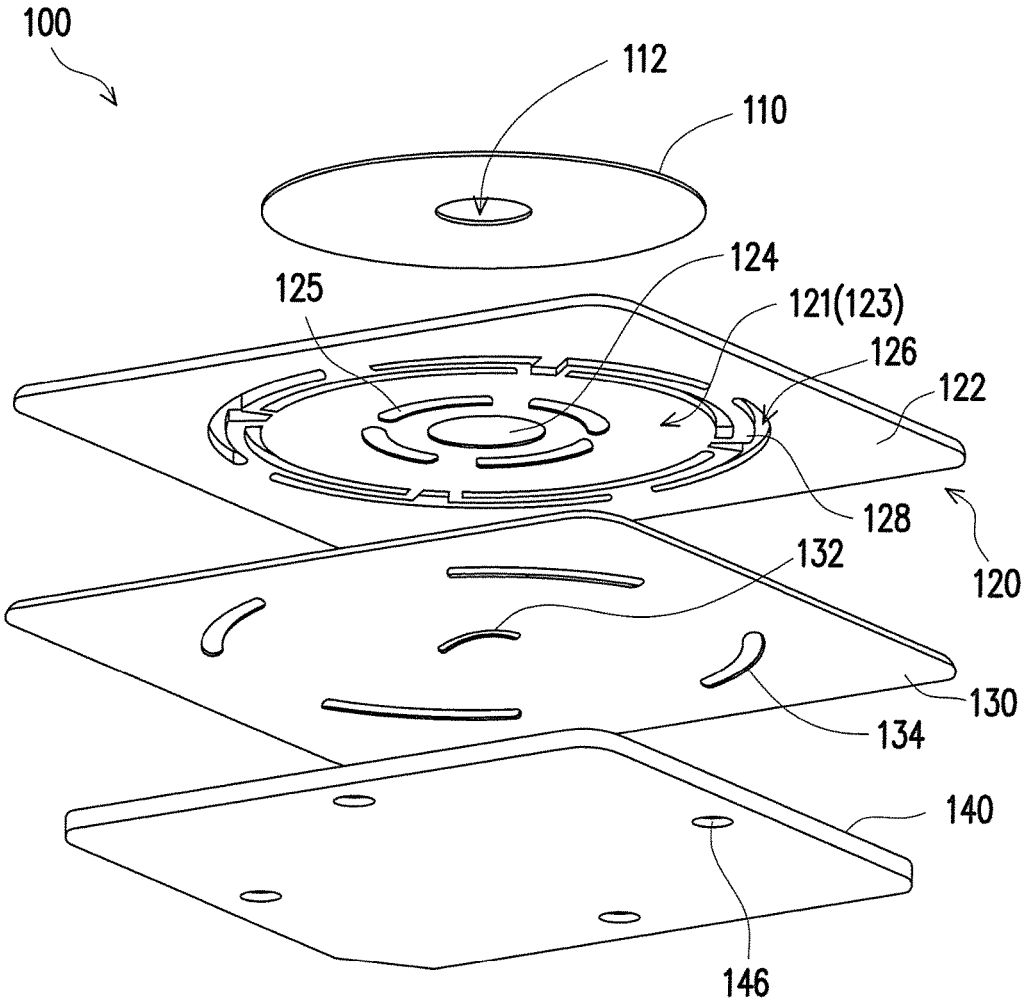
FIG. 2 is a schematic view depicted in FIG. 1 from another view angle.
Figure 3:
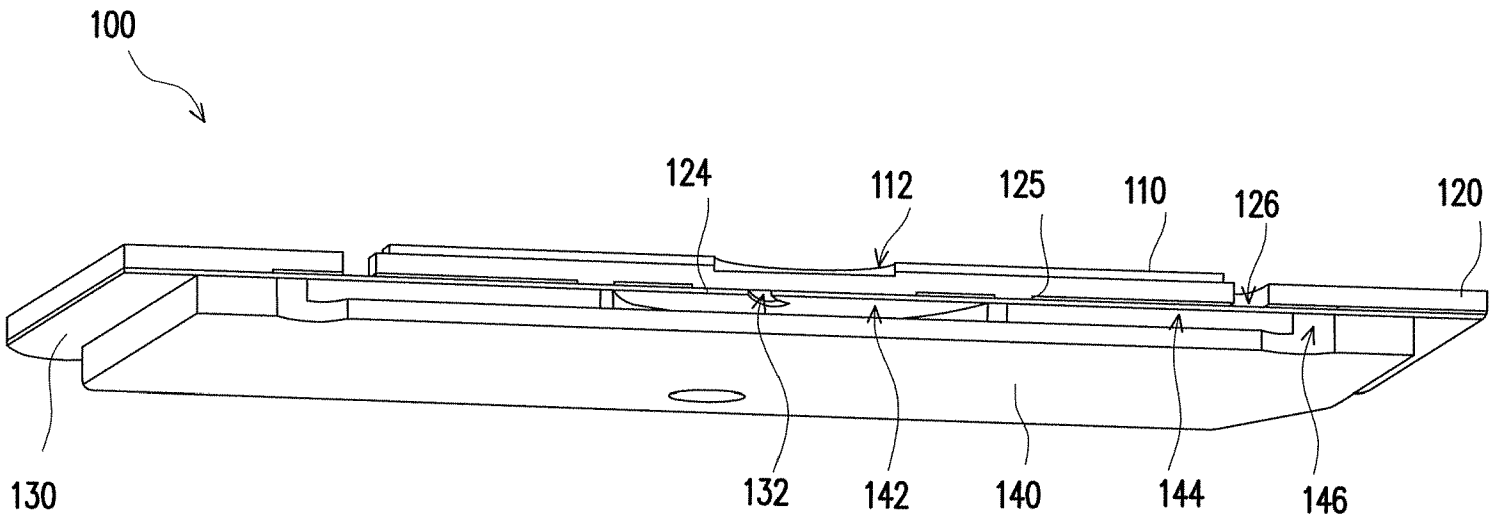
FIG. 3 is a schematic cross-sectional view showing the piezoelectric pump of FIG. 1 after assembled.
Figure 4:
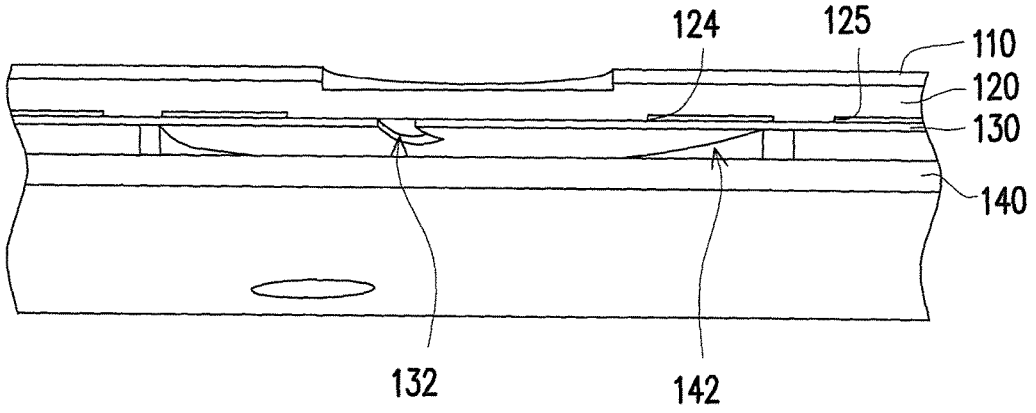
FIG. 4 is a partially enlarged schematic view of FIG. 3.

FIG. 1 is a schematic exploded view of a piezoelectric pump according to an embodiment of the disclosure. FIG. 2 is a schematic view depicted in FIG. 1 from another view angle. FIG. 3 is a schematic cross-sectional view showing the piezoelectric pump of FIG. 1 after assembled. FIG. 4 is a partially enlarged schematic view of FIG. 3. Referring to FIG. 1 through FIG. 4, the piezoelectric pump 100 of the embodiment includes a piezoelectric element 110, a vibrating piece 120, a valve 130 and a flow guiding member 140.

In the embodiment, the outer profile shape of the piezoelectric element 110 is a round shape and appears to be a sheet shape, and the piezoelectric element 110 includes a perforating hole 112 located at the center of the piezoelectric element 110. Certainly, in other embodiments, the outer profile shape of the piezoelectric element 110 may be a round shape, an elliptical shape, a triangle shape, a square shape, a hexagonal shape, or any other polygonal shape, and so on, and the shape of the piezoelectric element 110 is not limited in the disclosure.

The vibrating piece 120 includes a central zone 121, a peripheral zone 122, a first recess 123 (indicated in FIG. 2), a stopper 124 (indicated in FIG. 2), at least one position limiting wall 125 (indicated in FIG. 2), at least a through groove 126, a third recess 127 and a plurality of arm portions 128. In the embodiment, the material of the vibrating piece 120 may include copper, stainless steel, or any other suitable metal or metal alloy, having flexible characteristic, but the material of the vibrating piece 120 is not limited thereto.

The central zone 121 is a region on the vibrating piece 120 corresponding to the piezoelectric element 110, and the central zone 121 of the vibrating piece 120 is attached to the piezoelectric element 110. The peripheral zone 122 surrounds the central zone 121. As shown in FIG. 2, the first recess 123 is recessed in the surface which is away from the piezoelectric element 110, of the central zone 121, i.e., the lower surface shown in the drawing.

As shown in FIG. 2, the stopper 124 and the position limiting wall 125 protrude from the first recess 123. In the embodiment, the vibrating piece 120 includes four position limiting walls 125, and the position limiting walls 125 appear to be in arc shape and surround the stopper 124. In the embodiment, the stopper 124, the position limiting walls 125 and the peripheral zone 122 are located on the same plane, but in other embodiments, the stopper 124 and the position limiting walls 125 may be slightly lower than or higher than the plane which the peripheral zone 122 exists.

In the embodiment, the vibrating piece 120 includes a plurality of through grooves 126, the through grooves 126 appear to be in arc shape and surround the central zone 121, and each of the through grooves 126 is located between the central zone 121 and the peripheral zone 122 and communicated with the first recess 123.

In the embodiment, the arm portions 128 appear to be in arc shape and surround the central zone 121. The arm portions 128 are respectively connected to the central zone 121 and the peripheral zone 122, more specifically, the two ends of the arm portions 128 are connected to the central zone 121, and the centers of the arm portions 128 are connected to the peripheral zone 122.

Referring to FIG. 1, the third recess 127 is recessed in the surface which is near to the piezoelectric element 110, of the central zone 121 and corresponds to the location of the perforating hole 112. The vibrating piece 120 has a design of the third recess 127 via the central zone 121 and reduces the thickness of the central zone 121, as such, when it performs up and down vibration, the central zone 121 may have a larger vibration. Certainly, in other embodiments, the vibrating piece 120 may also omit the design of the third recess 127.

The valve 130 is attached to the surface (the lower surface of the vibrating piece 120) which is away from the piezoelectric element 110, of the peripheral zone 122 of the vibrating piece 120, namely, the vibrating piece 120 is disposed between the piezoelectric element 110 and the valve 130. The valve 130 includes at least one non-straight through slit 132 located at the center and a plurality of perforating grooves 134 surrounding the non-straight through slit 132. In the embodiment, the projection of the stopper 124 of the vibrating piece 120 projected on the valve 130 covers the non-straight through slit 132, namely, the location of the non-straight through slit 132 corresponds to the location of the stopper 124. Moreover, the locations of the perforating grooves 134 correspond to the arm portions 128 of the vibrating piece 120, used for providing spaces for the arm portions 128, so that the an portions 128 may penetrate the perforating grooves 134 during vibration and have a larger vibration. The material of the valve 130 may include copper, stainless steel, or any other suitable metal or metal alloy, having flexible characteristic, but the material of the valve 130 is not limited thereto.

Figure 5:
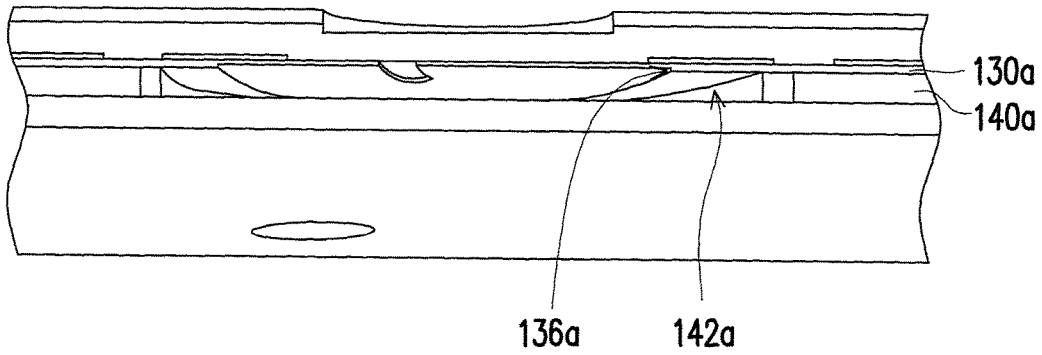
FIG. 5 is a schematic partial cross-sectional view of a piezoelectric pump according to another embodiment of the disclosure.

Certainly, the design of the valve 130 is not limited thereto. FIG. 5 is a schematic partial cross-sectional view of a piezoelectric pump according to another embodiment of the disclosure. Referring to FIG. 5, the valve **130*a* includes a fourth recess 136*a*, the fourth recess 136*a* is recessed in the surface which faces the flow guiding member 140*a*, of the valve 130*a*, and the fourth recess 136*a* corresponds to the second recess 142*a*. The fourth recess 136*a* is used for reducing the thickness of the center portion of the valve 130*a*, via this design, when a resonant vibration is generated between the valve 130*a* and the piezoelectric element 110**, the thinner center portion may have a larger vibration.

Referring to FIG. 1, the flow guiding member 140 is attached to the surface (the lower surface of the valve 130) which is away from the vibrating piece 120, of the valve 130, namely, the valve 130 is disposed between the vibrating piece 120 and the flow guiding member 140. The flow guiding member 140 includes a second recess 142, at least one channel 144, at least one through hole 146 and a plurality of slots 148. The second recess 142 is recessed in the surface (the upper surface of the flow guiding member 140) which faces the valve 130, of the flow guiding member 140, and the projection of the second recess 142 projected on the plane which the valve 130 exists covers the non-straight through slit 132.

The channel 144 is recessed in the upper surface of the flow guiding member 140, and the channel 144 is communicated with the second recess 142 and the through hole 146. In the embodiment, the flow guiding member 140 includes four channels 144 and four through holes 146, however, the numbers of the flow guiding member 140 and the channel 144 are not limited thereto. The channels 144 are in radial shape with the second recess 142 as a center, and the inlet diameter of the channel 144 gradually decreases from the through hole 146 to the second recess 142, thereby the fluid flowing through the one-way suppressing design that the channels 144 may be easy to flow into the second recess 142 but hard to flow out of the through hole 146, so as to achieve the function of controlling the flow direction of the fluid flowing in the channels 144.

The locations of the slots 148 correspond to the locations the arm portions 128, similar to the perforating grooves 134 of the valve 130, the slots 148 are used for the portions 128 to extend thereinto, so that the arm portions 128 may have a larger vibration. In addition, in the embodiment, the material of the flow guiding member 140 may include copper, stainless steel, or any other suitable metal or metal alloy, but the material of the flow guiding member 140 is not limited thereto.

Figure 6:
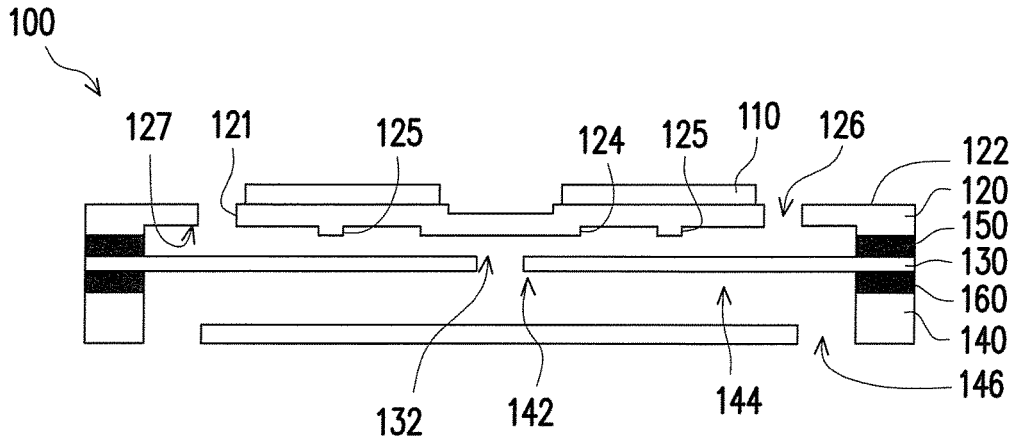
FIG. 6 through FIG. 8 are schematic cross-sectional views showing the piezoelectric pump of FIG. 1 during actuation.
Figure 7:
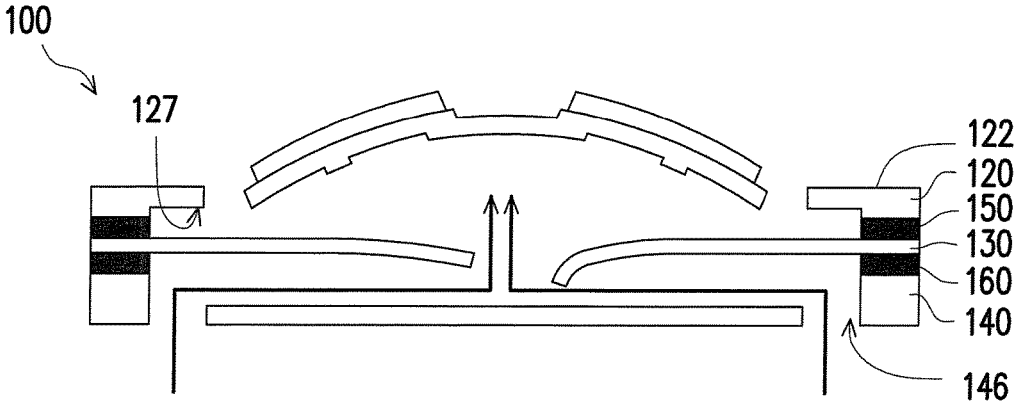
Figure 8:
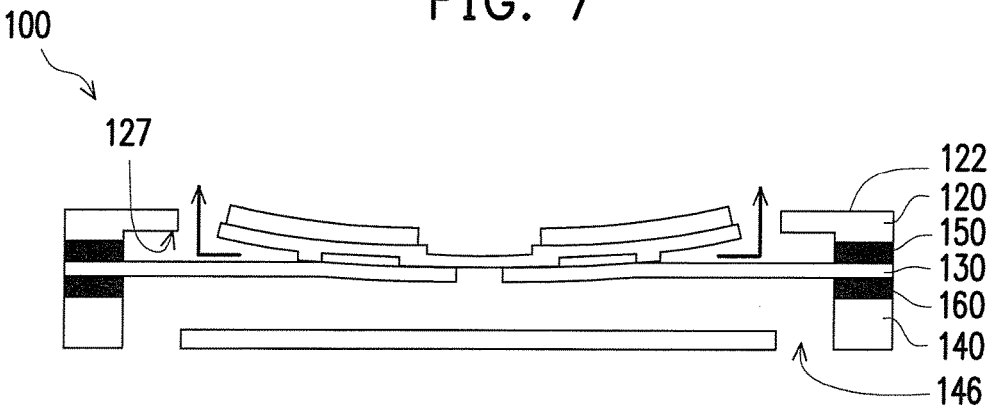

The following further explains the relative positions of the piezoelectric element 110, the vibrating piece 120, the valve 130 and the flow guiding member 140 when the piezoelectric pump 100 actuating. FIG. 6 through FIG. 8 are schematic cross-sectional views showing the piezoelectric pump of FIG. 1 during actuation. It should be described that, for the sake of clearness of viewing the flow path of the fluid flowing through within the piezoelectric pump 100, the thickness of a first adhesive layer 150 located between the vibrating piece 120 and the valve 130 and the thickness of a second adhesive layer 160 located between the valve 130 and the flow guiding member 140 are intentionally enlarged and shown. Additionally, FIG. 6 and FIG. 7 are schematic views respectively showing when the amount of upward and downward deformation of the piezoelectric pump 100 of FIG. 1 is maximum.

First, referring to FIG. 6, in FIG. 6, the piezoelectric pump 100 is located in the initial position, at this time, the piezoelectric element 110, the vibrating piece 120, the valve 130 and the flow guiding member 140 appear to be in a not-bent horizontal state. When the piezoelectric pump 100 starts to actuate, via the circuit control, the piezoelectric element 110 may move and also drives the vibrating piece 120 to move. Besides the piezoelectric element 110 directly drives the vibrating piece 120, in the embodiment, the vibrating piece 120 of the piezoelectric pump 100 and the valve 130 may be able to resonantly vibrate with the piezoelectric piece 110, thus the piezoelectric element 110 may cause the vibrating piece 120 and the valve 130 generate vibration with a large amplitude, merely via the driving of a small electric field at a specific frequency. The resonant vibration may cause the space between the vibrating piece 120 and the valve 130 to have a larger change. Compared to the situation that the vibrating piece 120 and the valve 130 make no resonant vibration, the effect that the vibrating piece 120 and the valve 130 of the piezoelectric pump 100 are resonantly vibrated by the piezoelectric element 110, may increase the vibration amplitude up to above 20%, and thereby the actuation efficiency of the piezoelectric pump 100 is increased.

In more detailed, when the piezoelectric pump 100 is operated, by providing a driving voltage at a specific frequency to the piezoelectric element 110 to drive the piezoelectric element 110 (e.g., if the diameter of the piezoelectric element 110 is about 8 mm to 22 mm, apply a driving voltage at 20 kHz to 30 kHz), the central zone 121 of the vibrating piece 120 not only moves in a direction away from the flow guiding member 140 (i.e., the above of the drawing) since driven by the piezoelectric element 110, but also the vibrating piece 120 may generate a resonant vibration corresponding to the vibrating frequency of the piezoelectric element 110, thus the vibrating piece 120 may generate a larger vibration magnitude. The valve 130 may also generate a resonant vibration corresponding to the vibrating frequency of the piezoelectric element 110. Since the valve 130 is attached to the region of the flow guiding member 140 beyond the second recess 142, the portion that the valve 130 is not attached to the flow guiding member 140 may vibrate up and down due to the resonant vibration. In the embodiment, the resonant vibration mode of the vibrating piece 120 and the valve 130 may facilitate the central zone 121 of the vibrating piece 120 and the region of the valve 130 corresponding to the central zone 121 to generate a maximum amplitude, thereby the piezoelectric element 110 may be changed from the status of FIG. 6 to the status of FIG. 7.

In FIG. 7, the vibrating piece 120 moves upward, the valve 130 correspondingly moves downward due to the effect of resonant vibration, so that the central zone 121 of the vibrating piece 120 is away from the valve 130, the space between the first recess 123 of the vibrating piece 120 and the valve 130 may become larger, the pressure thus becomes smaller, such that the fluid from external may be guided to the space between the valve 130 and the first recess 123 of the vibrating piece 120 from the through hole 146, the channels 144, the second recess 142 and the non-straight through slit 132.

And then, the vibrating piece 120 moves downward and gradually returns back to the location as shown in FIG. 6. Next, the vibrating piece 120 continuously moves downward and appears to be in the downwardly recessed shape as shown in FIG. 8. During the process that gradually vibrating in FIG. 7 to FIG. 6 and FIG. 8, since the space between the first recess 123 of the vibrating piece 120 and the valve 130 becomes gradually smaller, such that the pressure within the space becomes larger, the fluid which is originally located between the first recess 123 of the vibrating piece 120 and the valve 130 may be squeezed and move toward the through grooves 126 of the vibrating piece 120, and then flows out of the piezoelectric pump 100.

As shown in FIG. 8, when the vibrating piece 120 appears to be downwardly recessed, the stopper 124 located on the lower surface of the vibrating piece 120 may prop against the valve 130, shield the non-straight through slit 132, then the fluid which is originally located between the first recess 123 of the vibrating piece 120 and the valve 130 may not flow from the non-straight through slit 132 to the second recess 142 of the flow guiding member 140. In other words, at this time, the flow path between the valve 130 and the flow guiding member 140 is temporarily closed, so as to suppress the back flow of the fluid.

It should to be described that, in the embodiment, when the vibrating piece 120 is located in the status shown in FIG. 8, the position limiting walls 125 located at the lower surface of the vibrating piece 120 may be contact with the valve 130 and is restricted by the valve 130 and cannot continuously move downward. In other words, the piezoelectric pump 100 may limit the movement magnitude of the vibrating piece 120 moving downward in a direction toward the valve 130, via the position limiting walls 125 disposed on the surface which faces the valve 130, of the vibrating piece 120, so that during the process that the vibrating piece 120 vibrates up and down, the movement magnitude of the vibrating piece 120 moving in a direction away from the valve 130 (i.e., the upwardly protruded magnitude shown in FIG. 7) may be larger than the movement magnitude of the vibrating piece 120 moving in a direction near to the valve 130 (i.e., the downwardly recessed magnitude shown in FIG. 8). This design may facilitate the fluid to be inclined to the through hole 146 of the flow guiding member 140, absorbed into the space between the first recess 123 of the vibrating piece 120 and the valve 130 along the channels 144, the second recess 142 and the non-straight through slit 132, so that the fluid flow in a one-way direction.

In addition, since the non-straight through slit 132 of the valve 130 has a design of an arc shape which is a non-straight line, a non-circular, or other shapes, when the fluid passes through the non-straight through slit 1323, the portion beside the non-straight through slit 132 of the valve 130 (i.e., the portion of the valve 130 that appears to be in a tongue shape) may be opened and the opening size for ventilation is increased. In other words, the area of the fluid when passing through the valve 130 may be larger than the area of the non-straight through slit 132 itself, so that the fluid may pass through the valve 130 more smoothly.

As such configuration, when the vibrating piece 120 moves upward, the fluid may rapidly enter the space between the first recess 123 of the vibrating piece 120 and the valve 130; when the vibrating piece 120 moves downward, the stopper 124 may prop against the non-straight through slit 132 of the valve 130, so that the fluid will not flow back downward. In other words, via the piezoelectric element 110 reciprocally driving the vibrating piece 120 to vibrate up and down (repeating the positions of FIG. 6, FIG.

7, FIG. 6, FIG. 8), and the vibrating piece 120 and the valve 130 correspondingly resonantly vibrating, the fluid may high efficiently enter the piezoelectric pump 100 in a one-way direction from the through holes 146 of the flow guiding member 140, pass through the channels 144, the second recess 142, the non-straight through slit 132 and the first recess 123, and leave the piezoelectric pump 100 from the through grooves 126.

Figure 9A:
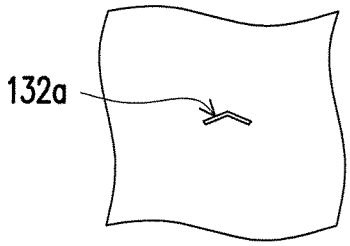
FIG. 9A through FIG. 9H are schematic partial views showing valves of various types of piezoelectric pumps according to other embodiments of the disclosure.
Figure 9B:
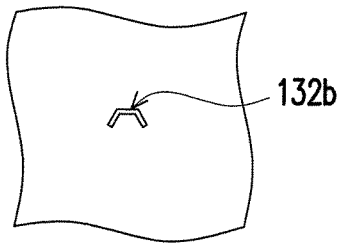

It should be noted that, in the abovementioned embodiments, only one of the non-straight through slits 132 of the valve 130 appears to be in an arc shape, but the number and shape of the non-straight through slits 132 of the valve 130 are not limited thereto. FIG. 9A through FIG. 9H are schematic partial views showing valves of various types of piezoelectric pumps according to other embodiments of the disclosure. Referring to FIG. 9A and FIG. 9B, the non-straight through slits 132*a*, 132*b* are composed of a plurality of straight lines, namely, the shapes of the non-straight through slits 132*a*, 132*b* are a portion of a polygonal shape. For example in FIG. 9A, the non-straight through slit 132*a* is formed by two connected straight lines, and in FIG. 9B, the non-straight through slit 132*b* is formed by three connected straight lines in which any two of them are connected. Certainly, the non-straight through slit 132*a*, 132*b* are not limited to be formed by two connected lines or three connected lines.

Figure 9C:
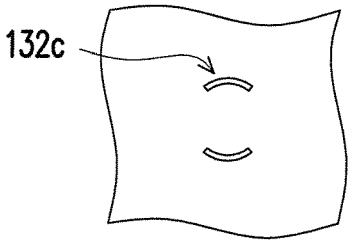
Figure 9D:
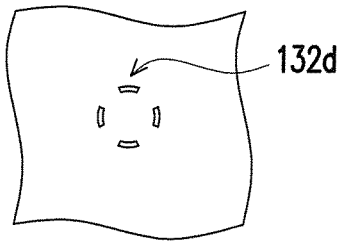
Figure 9E:
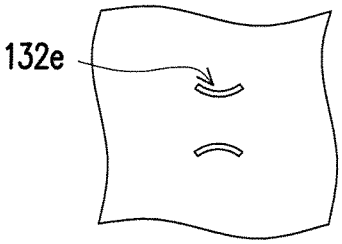
Figure 9F:
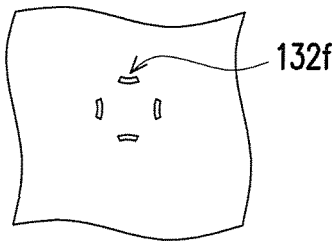
Figure 9G:
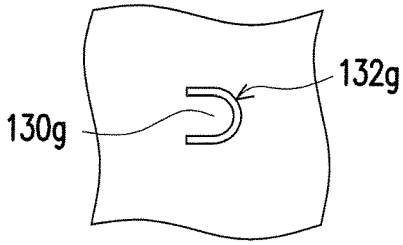
Figure 9H:
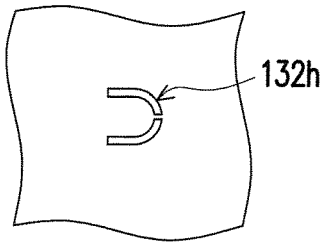

In FIG. 9C and FIG. 9D, the number of the non-straight through slits 132*c*, 123*d* is plural, more specifically, the numbers of the non-straight through slits 132*c*, 132*d* are two and four, respectively. The difference between FIG. 9E, FIG. 9F and FIG. 9C, FIG. 9D is the directions of the arc shapes of the non-straight through slits 132*e*, 132*f*. The directions of the arc shapes of the non-straight through slits 132*e*, 132*f* of FIG. 9E and FIG. 9F are opposite to the directions of the arc shapes of the non-straight through slits 132*c*, 132*d*. In FIG. 9G, the shape of the non-straight through slits 132*g* is a U shape, so that the region of the valve 130*g* surrounded by the non-straight through slits 132*g* is similar to a tongue shape. The difference between FIG. 9H and FIG. 9G is the shape of each of the non-straight through slits 132*h* is a portion of U shape. Certainly, the above mentioned descriptions merely show a portion of the shapes of the non-straight through slits 132*a* to 132*h*, however, the shape of the non-straight through slits may also be irregular shape, or combination of the abovementioned shapes, and is not limited by the disclosure.

Figure 10A:
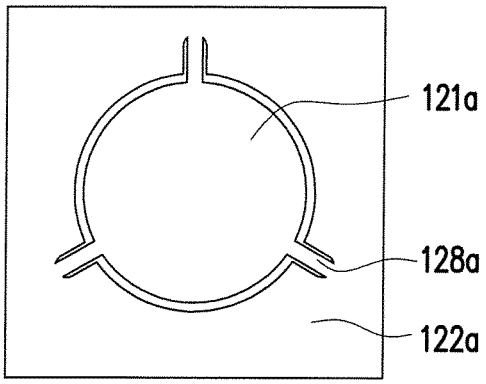
FIG. 10A through FIG. 10C are schematic partial views showing portions of vibrating pieces of various types of piezoelectric pumps according to other embodiments of the disclosure.
Figure 10B:
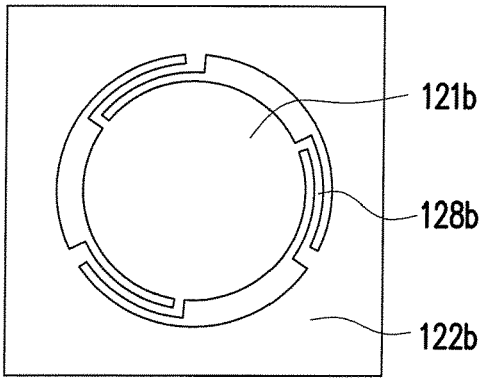
Figure 10C:
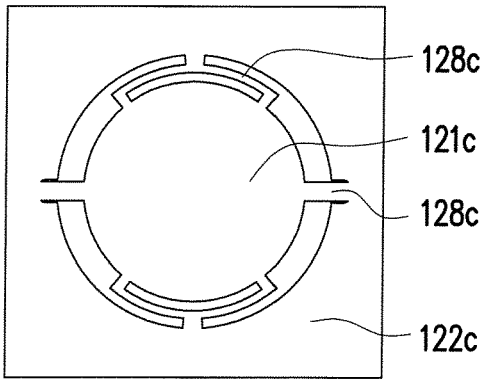

In addition, in the abovementioned embodiments, the arm portions 128 are in arc shapes and surround the central zone 121, the two ends of the arm portions 128 are connected to the central zone 121, and the center of the arm portions 128 is connected to the peripheral zone 122, however, the types of the portions 128 are not limited thereto. Herein other types of arm portions of the vibrating pieces are described for reference. FIG. 10A through FIG. 10C are schematic partial views showing arm portions of vibrating pieces of various types of piezoelectric pumps according to other embodiments of the disclosure. Referring to FIG. 10A, the portion 128*a* is located beyond the central zone 121*a* and extends straightly in a radial shape, one end of the arm portion 128*a* is connected to the central zone 121*a* and the other end is connected to the peripheral zone 122*a*. In FIG. 10B, the arm portion 128*b* is in an arc shape and surrounds the central zone 121*b*, one end of the arm portion 128*b* is connected to the central zone 121*b* and the other end is connected to the peripheral zone 122*b*. In FIG. 10C, a portion of the arm portion 128*c* is the same as the arm portion 128 in FIG. 1, the arm portion 128*c* is in an arc shape and surrounds the central zone 121*c*, the two ends of the arm portion 128*c* are connected to the central zone 121*c*, and the center of the arm portion 128*c* is connected to the peripheral zone 122*c*. Another portion of the arm portion 128*c* is the same as the portion 128*a* in FIG. 10A, the arm portion 128*c* is located beyond the central zone 121*c*, and extends straightly in a radial shape, one end of the arm portion 128*c* is connected to the central zone 121*c* and the other end is connected to the peripheral zone 122*c*. Certainly, the above mentioned descriptions merely show a portion of the shapes of the arm portions 128*a* to 128*c*, however, the shape of the atm portions may also be irregular shape, or combination of the abovementioned shapes, and is not limited by the disclosure.

In the abovementioned embodiments, the vibrating piece 120 includes four position limiting walls 125, and the position limiting walls 125 appear to be in an arc shape, but the number and types of the position limiting walls are not limited thereto.

Figure 11A:
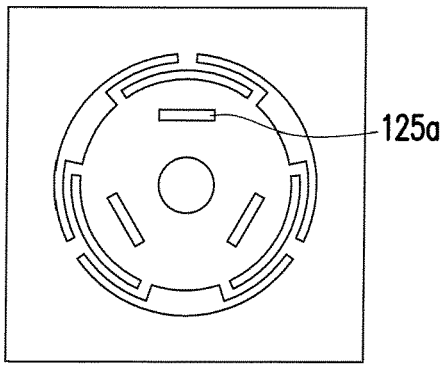
FIG. 11A through FIG. 11C are schematic partial views showing position limiting walls of vibrating pieces of various types of piezoelectric pumps according to other embodiments of the disclosure.
Figure 11B:
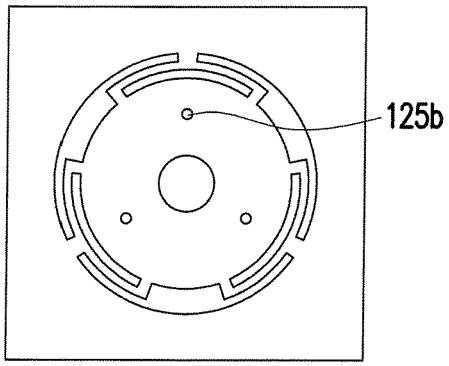
Figure 11C:
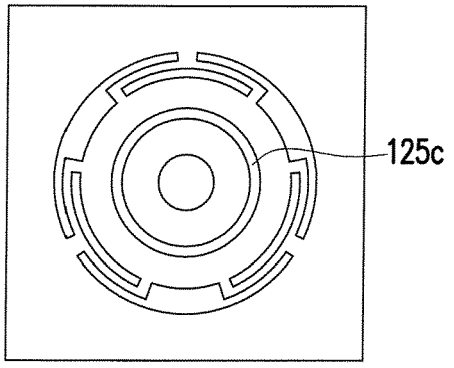

Herein other types of arm portions of the position limiting walls are described for reference. FIG. 11A and FIG. 11B are schematic partial views showing position limiting walls of vibrating pieces of various types of piezoelectric pumps according to other embodiments of the disclosure. In FIG. 11A, the shape of the position limiting walls 125*a* is a strip shape, in FIG. 11B, the shape of the position limiting walls 125*b* is a round shape. In FIG. 11C, the number of the position limiting walls 125*c* is only one and the shape is a circular shape, but in other embodiments, the position limiting wall 125*c* may be a plurality and circular shapes with different diameters. Or, in other embodiments, the shape of the position limiting walls may be a square shape or an irregular shape, and it is not limited by the drawings.

Figure 12A:
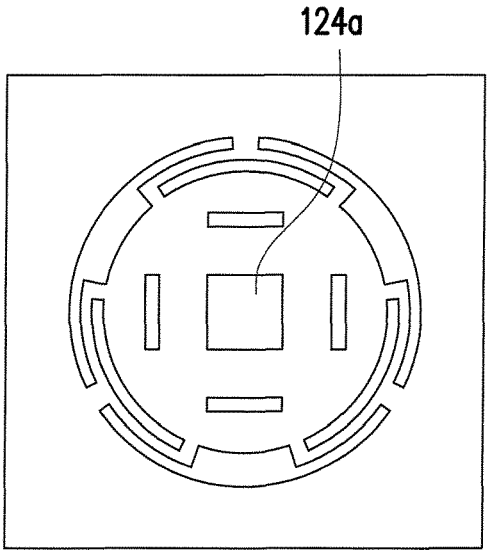
FIG. 12A and FIG. 12B are schematic partial views showing stoppers of vibrating pieces of various types of piezoelectric pumps according to other embodiments of the disclosure.
Figure 12B:
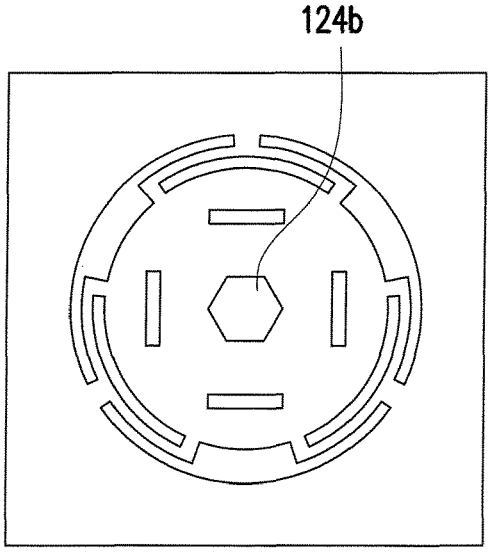

In the abovementioned embodiments, the shape of projection of the stopper 124 projected on the valve 120 is a round shape, but the shape of the stopper 124 is not limited thereto. FIG. 12A and FIG. 12B are schematic partial views showing stoppers of vibrating pieces of various types of piezoelectric pumps according to other embodiments of the disclosure. In FIG. 12A, the shape of the stopper 124*a* is a quadrilateral shape, in FIG. 12B, the shape of the stopper 124*b* is a hexagonal shape. Certainly, in other embodiments, the shape of the stopper may be an elliptical shape, any other polygonal shapes or an irregular shape, and it is not limited by the drawings.

Figure 13:
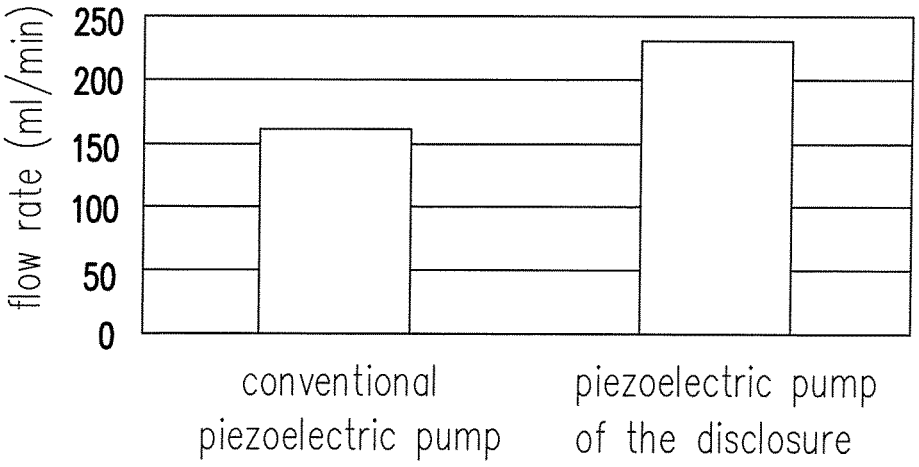
FIG. 13 is a diagram schematically showing the comparison between the flow rate of a conventional piezoelectric pump and the flow rate of the piezoelectric pump of FIG. 1.

FIG. 13 is a diagram schematically showing the comparison between the flow rate of a conventional piezoelectric pump and the flow rate of the piezoelectric pump of FIG. 1. Referring to FIG. 13, the flow rate of the fluid per minute output by a conventional piezoelectric pump is about 160 ml, while the flow rate of the fluid per minute output by the piezoelectric pump of the embodiment is about 230 ml, namely, compared to the conventional piezoelectric pump, the piezoelectric pump of the embodiment has a 70 ml per minute gain, and the growth rate is almost 40%.

In light of the foregoing, the piezoelectric element of the piezoelectric pump of the disclosure may moves up and down when electrically powered, besides directly driving the vibrating piece, by inputting a driving voltage at a specific frequency to the piezoelectric element, the vibrating piece and the valve may generate a resonantly vibrating status in which the central zone of the vibrating piece and the region of the valve corresponding to the central zone may have a maximum amplitude, thereby increasing the vibrating amplitude of the vibrating piece and the valve, and further capable of driving the fluid to flow through. In more detailed, when the piezoelectric element moves in a direction away from the flow guiding member, the central zone of the vibrating piece is away from the valve, the stopper and the position limiting wall may be separated from the valve by a small distance, such that the fluid may be guided to a space between the valve and the first recess of the vibrating piece from the through hole, the channel, the second recess, and the non-straight through slit. Via the design of the non-straight through slit, when the fluid passes through the non-straight through slit, the non-straight through slit may be opened and increase the size of the opening due to the resonant vibration, thereby the flow resistance is reduced and the ventilation rate is increased. When the piezoelectric element is back to its position and moves in a direction near to the flow guiding member, the fluid located between the valve and the first recess of the vibrating piece may be squeezed out of the through groove of the vibrating piece, and the central zone of the vibrating piece may approach the valve, the non-straight through slit may be restored to be the planar slit status due to the resonant vibration, the opening of the non-straight through slit may become smaller and thus the flow resistance increases, further, the stopper protruding from the first recess may prop against the valve and shield the non-straight through slit, the fluid is hard to flow to the second recess of the flow guiding member from the non-straight through slit. In other words, at this time the flow resistance of the flow path between the valve and the flow guiding member may gradually be increased and temporarily closed, so as to achieve the status of suppressing back flow of the fluid. In addition, the vibrating piece has a position limiting wall, disposed on the surface which faces the valve, which may limit the magnitude of movement of the vibrating piece when it moves in a direction to the valve, namely, the magnitude of movement of the vibrating piece moving in a direction away from the valve may be larger than the magnitude of the movement moving in a direction near to the valve, such that the fluid may flow into the piezoelectric pump from the through hole in a single direction, passing through the channel, the second recess, the non-straight through slit, the first recess, and then leaves the piezoelectric pump via the through groove.

Although the disclosure has been described with reference to the above embodiments, it will be apparent to one of ordinary skill in the art that modifications to the described embodiments may be made without departing from the spirit of the disclosure. Accordingly, the scope of the disclosure will be defined by the attached claims and not by the above detailed descriptions.

What is claimed is:

1. A piezoelectric pump, comprising:

a piezoelectric element;

a vibrating piece having a central zone, a peripheral zone, a first recess, a stopper, at least one position limiting wall, and at least one through groove; wherein the central zone corresponds to the piezoelectric element, the central zone is attached to the piezoelectric element, the peripheral zone surrounds the central zone, the first recess is recessed in a surface of the central zone which is away from the piezoelectric element, the stopper and the at least one position limiting wall protrude from the first recess, the at least one through groove is located between the central zone and the peripheral zone and communicated with the first recess, a first thickness of the vibrating piece at a center portion of the central zone is less than a second thickness of the vibrating piece at the at least one position limiting wall;

a valve, attached to a surface of the peripheral zone of the vibrating piece which is away from the piezoelectric element, and having at least one non-straight through slit, wherein a projection of the stopper of the vibrating piece projected on the valve covers the at least one non-straight through slit; and a flow guiding member, attached to a surface of the valve which is away from the vibrating piece, and having a second recess, at least one channel and at least one through hole, wherein the second recess and the at least one channel of the flow guiding member are recessed in a surface which faces the valve, the at least one channel is communicated with the second recess and the at least one through hole, a projection of the second recess projected on a plane which the valve exists covers the at least one non-straight through slit, wherein when the piezoelectric element is driven by a driving voltage at a specific frequency, the vibrating piece and the valve resonantly vibrate with the piezoelectric element, such that the central zone of the vibrating piece and a region of the valve corresponding to the central zone have a maximum amplitude, wherein when a fluid passes through the at least one non-straight through slit, a portion beside the at least one non-straight through slit of the valve is pushed by the fluid so as to temporarily form an opening whose size is greater than a size of the at least one non-straight through slit of the valve.

2. The piezoelectric pump as claimed in claim 1, wherein the piezoelectric element comprises a perforating hole, the vibrating piece comprises a third recess, the third recess is recessed in a surface of the central zone which is near to the piezoelectric element, and the third recess corresponds to a location of the perforating hole.

3. The piezoelectric pump as claimed in claim 1, wherein the vibrating piece comprises a plurality of arm portions, respectively connected to the central zone and the peripheral zone, the arm portions extend in a straight line or an are line.

4. The piezoelectric pump as claimed in claim 3, wherein the valve comprises a plurality of perforating grooves, the flow guiding member comprises a plurality of slots, locations of the perforating grooves and the slots respectively correspond to locations of the arm portions, for the arm portions extending thereinto.

5. The piezoelectric pump as claimed in claim 1, wherein the valve comprises a fourth recess, the fourth recess is recessed in a surface of the valve which faces the flow guiding member, and the fourth recess corresponds to the second recess.

6. The piezoelectric pump as claimed in claim 1, wherein an inlet diameter of the at least one channel gradually decreases from the through hole to the second recess.

7. The piezoelectric pump as claimed in claim 1, wherein the vibrating piece comprises a plurality of position limiting walls, the position limiting walls surround the stopper, a shape of projection of each of the position limiting walls projected on the valve comprises a curved shape, an elongated shape, a round shape, a square shape, a circular shape or an irregular shape, or the vibrating piece comprises the position limiting wall, a shape of the position limiting wall is a circular shape and surrounds the stopper.

8. The piezoelectric pump as claimed in claim 1, wherein a shape of projection of the stopper projected on the valve comprises a round shape, an elliptical shape, a polygonal shape or an irregular shape.

9. An operation method of a piezoelectric pump, comprising:

providing a piezoelectric pump, wherein the piezoelectric pump comprises:

a piezoelectric element;

a vibrating piece having a central zone, a peripheral zone, a first recess, a stopper, at least one position limiting wall, and at least one through groove; wherein the central zone corresponds to the piezoelectric element, the central zone is attached to the piezoelectric element, the peripheral zone surrounds the central zone, the first recess is recessed in a surface of the central zone which is away from the piezoelectric element, the stopper and the at least one position limiting wall protrude from the first recess, the at least one through groove is located between the central zone and the peripheral zone and communicated with the first recess, a first thickness of the vibrating piece at a center portion of the central zone is less than a second thickness of the vibrating piece at the at least one position limiting wall;

a valve, attached to a surface of the peripheral zone of the vibrating piece which is away from the piezoelectric element, and having at least one non-straight through slit, wherein a projection of the stopper of the vibrating piece projected on the valve covers the at least one non-straight through slit; and a flow guiding member, attached to a surface of the valve which is away from the vibrating piece, and having a second recess, at least one channel and at least one through hole, wherein the second recess and the at least one channel of the flow guiding member are recessed in a surface which faces the valve, the at least one channel is communicated with the second recess and the at least one through hole, a projection of the second recess projected on a plane which the valve exists covers the at least one non-straight through slit; and providing a driving voltage at a specific frequency to drive the piezoelectric element;

the central zone of the vibrating piece, as driven by the piezoelectric element, moving in a direction away from the flow guiding member, and generating a resonant vibration corresponding to the specific frequency of the piezoelectric element;

a region of the valve, corresponding to the central zone of the vibrating element, as driven by the piezoelectric piece, generating a resonant vibration corresponding to the specific frequency of the piezoelectric element so as to move in a direction towards the flow guiding member, such that a space between the first recess of the vibrating piece and the valve becomes larger, a fluid from an external source is guided to the space between the valve and the first recess of the vibrating piece from the at least one through hole, the at least one channels, the second recess and the at least one non-straight through slit, wherein when the fluid passes through the at least one non-straight through slit, a portion beside the at least one non-straight through slit of the valve is pushed by the fluid so as to temporarily form an opening whose size is greater than a size of the at least one non-straight through slit of the valve.

* * * * *